US010028567B2

(12) United States Patent
Lee et al.

(10) Patent No.: US 10,028,567 B2
(45) Date of Patent: Jul. 24, 2018

(54) LIPSTICKS AND LIP APPLICATORS

(71) Applicant: Kiss Nail Products, Inc., Port Washington, NY (US)

(72) Inventors: Ji Yeon Lee, Long Island City, NY (US); Sung An Chae, Levittown, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 15/152,143

(22) Filed: May 11, 2016

(65) Prior Publication Data

US 2017/0325569 A1 Nov. 16, 2017

(51) Int. Cl.

| | |
|---|---|
| ***B43K 21/08*** | (2006.01) |
| ***A45D 40/06*** | (2006.01) |
| *A45D 40/20* | (2006.01) |

(52) U.S. Cl.

CPC ..... *A45D 40/06* (2013.01); *A45D 40/065* (2013.01); *A45D 2040/208* (2013.01)

(58) Field of Classification Search

CPC . A45D 40/06; A45D 40/065; A45D 2040/208
USPC ..... 401/78
See application file for complete search history.

(56) References Cited

U.S. PATENT DOCUMENTS

| | | | | |
|---|---|---|---|---|
| 3,338,397 A * | 8/1967 | Noyack | ..... | A45D 40/02 132/320 |
| 4,208,144 A * | 6/1980 | Idec | ..... | A45D 40/06 132/320 |
| 7,908,749 B2 * | 3/2011 | Sasaki | ..... | A45D 40/04 30/451 |

* cited by examiner

*Primary Examiner* — Jennifer C Chiang
(74) *Attorney, Agent, or Firm* — Hunton, Andrews, Kurth LLP

(57) ABSTRACT

A lip application device, such as a lipstick, may have four peripheral portions in its cross section. The cross section may have a center through which a radial axis extends in parallel to the cross section, dividing the cross section into left and right sides. A first portion may form a first arc centered at the radial axis and having an outward radial direction stemming from the center. A second portion may form a second arc centered at the radial axis and having an outward radial direction stemming from the center, the second arc being opposite to the first arc and being longer than the first arc. A third portion and a fourth portion may be substantially straight lines, one connecting the ends points of the two arcs in the left side and other connecting the end points of the two arcs in the right side.

23 Claims, 6 Drawing Sheets

LIPSTICKS AND LIP APPLICATORS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The technology described herein relates generally to topical applicators for lips and more specifically to lipsticks, lip balm, lip gloss and the like.

2. Description of Related Art

Topical lip applicator products such as lipsticks, lip balm, lip gloss, etc. are commonly used to apply cosmetic or treatment material to lips. Conventional lip applicators often have a bullet-shaped body formed using the material that is to be applied. A bullet-shaped lipstick, for example, typically has a cylindrical body with a pointed application tip and a surface extending from the cylindrical body to the tip. This surface is usually used for applying lipstick to both the top and bottom lips. This one-size-fits-all approach, however, is not ideal because top and bottom lips often have different characteristics requiring different application surfaces (e.g., the bottom lip may be fuller).

SUMMARY

The lip applicator device (e.g., lipstick container) or the material held by the device (e.g., lipstick body), as described herein, may have a non-cylindrical cross section such that different application surfaces may be formed.

In an aspect, a lipstick container includes a container body extending along a longitudinal axis and including a first end having an upper portion and a lower portion, a second end, and a cross section perpendicular to the longitudinal axis, the cross section including a center through which an axis extends in parallel to the cross section, the axis dividing the cross section into a left side and a right side, a first peripheral portion intersecting the axis at an upper portion of the cross section, and a second peripheral portion intersecting the axis at a lower portion of the cross section, the second peripheral portion being longer than the first peripheral portion, where a distance extending longitudinally from the upper portion of the first end of the container body to the second end of the container body is different than a distance extending longitudinally from the lower portion of the first end of the container body to the second end of the container body.

In another aspect, a lipstick includes a container extending along a longitudinal axis, and a lipstick body positioned within the container, extending along the longitudinal axis, and including a first end having an upper portion and a lower portion, a second end, and a cross section perpendicular to the longitudinal axis, the cross section including a center through which an axis extends in parallel to the cross section, the axis dividing the cross section into a left side and a right side, a first peripheral portion intersecting the axis at an upper portion of the cross section, and a second peripheral portion intersecting the axis at a lower portion of the cross section, the second peripheral portion being longer than the first peripheral portion, wherein a distance extending longitudinally from the upper portion of the first end of the lipstick body to the second end of the lipstick body is different than a distance extending longitudinally from the lower portion of the first end of the lipstick body to the second end of the lipstick body.

In yet another aspect, a lipstick container includes a container body extending along a longitudinal axis and including a first end having an upper portion and a lower portion, a second end, and a cross section perpendicular to the longitudinal axis, the cross section including a center through which an axis extends in parallel to the cross section, the axis dividing the cross section into a left side and a right side, a first peripheral portion intersecting the axis at an upper portion of the cross section, a second peripheral portion intersecting the axis at a lower portion of the cross section, the second peripheral portion being longer than the first peripheral portion, a third peripheral portion that forms a first substantially straight line connecting a first end point of the first peripheral portion and a first end point of the second peripheral portion in the left side of the cross section, and a fourth peripheral portion that forms a second substantially straight line connecting a second end point of the first peripheral portion and a second end point of the second peripheral portion in the right side of the cross section.

In an additional aspect, a lipstick includes a container extending along a longitudinal axis, and a lipstick body positioned within the container, extending along the longitudinal axis, and including a first end having an upper portion and a lower portion, a second end, and a cross section perpendicular to the longitudinal axis, the cross section including a center through which an axis extends in parallel to the cross section, the axis dividing the cross section into a left side and a right side, a first peripheral portion intersecting the axis at an upper portion of the cross section, and a second peripheral portion intersecting the axis at a lower portion of the cross section, the second peripheral portion being longer than the first peripheral portion, a third peripheral portion that forms a first substantially straight line connecting a first end point of the first peripheral portion and a first end point of the second peripheral portion in the left side of the cross section, and a fourth peripheral portion that forms a second substantially straight line connecting a second end point of the first peripheral portion and a second end point of the second peripheral portion in the right side of the cross section.

DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

FIG. 1A is a perspective view, FIG. 1B is a side view, FIG. 1C is a front view, FIG. 1D is a bottom view, and FIG. 1E is a top view.

FIG. 3A is a perspective view, FIG. 3B is a side view, FIG. 3C is a second side view, and FIG. 3D is a top view.

FIG. 4A is a longitudinal cross sectional view and FIG. 4B is a latitudinal cross sectional view.

FIG. 5A is a perspective view, FIG. 5B is a second perspective view from the opposite angle, FIG. 5C is a side view, FIG. 5D is a second side view, and FIG. 5E is a top view.

FIG. 6A is a longitudinal cross sectional view and FIG. 6B is a latitudinal cross sectional view.

DETAILED DESCRIPTION OF THE INVENTION

Figure 1C:
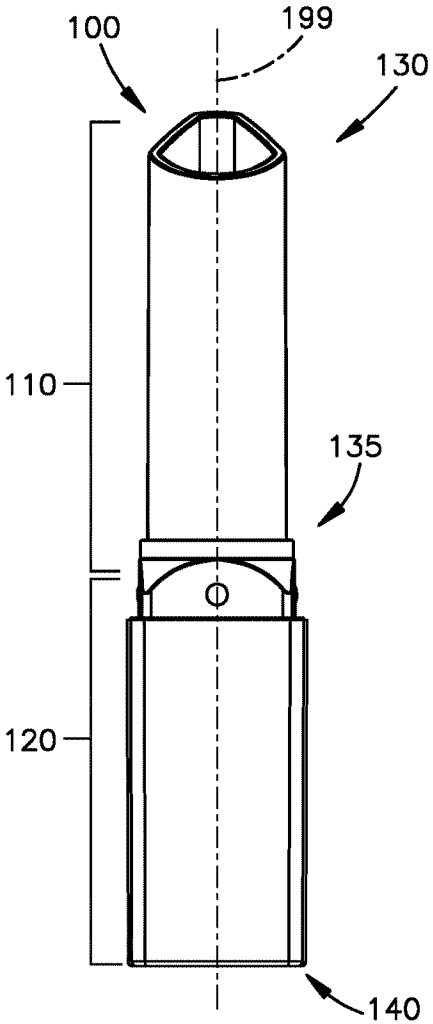
FIGS. 1A-1E are diagrams illustrating various views of an example of a device for applying cosmetic or treatment material to lips.

Before explaining at least one example of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiment incorporating aspects of the present inventions will require numerous implementation—specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the Figures and are not intended to limit the scope of the invention or the appended claims. Further, it should be understood that any one of the features of the invention may be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

Further, for purposes of simplifying the description of the device for applying cosmetic or treatment materials to lips, the device will hereinafter be referred to as a lipstick device, which is but one embodiment of the device. It is to be understood that the device may be used for applying any material, including but not limited to lip balm, lip gloss, etc.

Figure 1B:
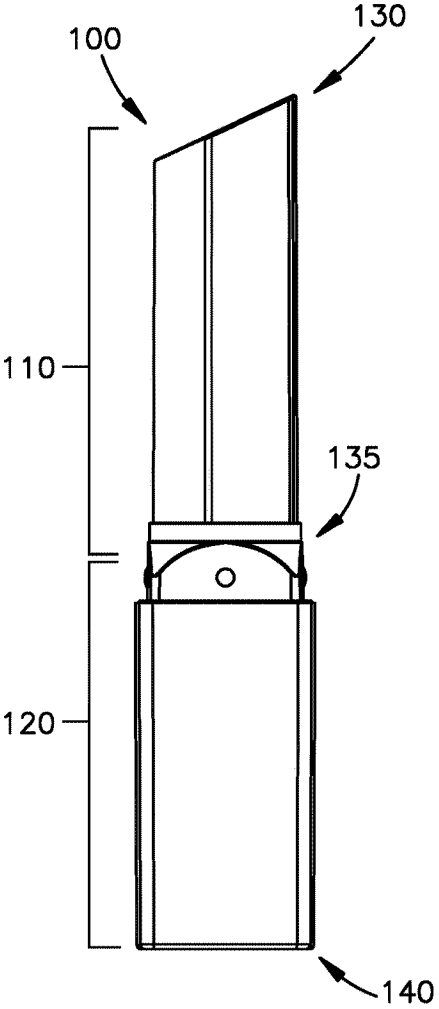
Figure 1A:
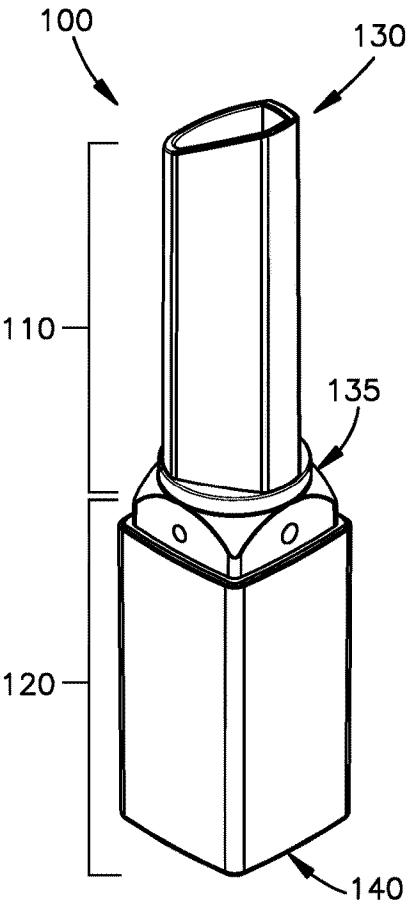

FIGS. 1A-1E illustrate various views of an example of a device for applying cosmetic or treatment material to lips, such as a lipstick device 100. FIG. 1A shows a perspective view of an exemplary lipstick device 100. The lipstick device 100 includes a lipstick container including a lipstick container portion 110, a container base 135, and a handle 120. The lipstick device 100 may also include a lipstick body (not shown) that is positioned in the lipstick container portion 110 of the lipstick container.

The lipstick container portion 110 has a hollow casing configured to surround and support a lipstick body (or other lip cosmetic or treatment material) that has an application end and a base end opposite to the application end. The lipstick container 110 and its hollow casing extend along a longitudinal axis and have a cross section perpendicular to the longitudinal axis. The lipstick container 110 is attached to a container base 135, which in turn is secured to a handle 120 for a user to hold and adjust the lipstick. The lipstick device 100 has a top application end 130 and a bottom 140. The application end 130 of the lipstick device 100 may in some embodiments be angled or slanted relative to a latitudinal cross sectional plane. As illustrated, in this example, the lipstick container 110 portion includes four sides, or four peripheral portions: a larger curved arc, a substantially shorter opposite side (which could be curved or straight), and two substantially straight sides joining the larger curved arc and the substantially shorter opposite side. In one embodiment, the larger curved arc side is, e.g., designed for applying lipstick to the bottom lip and the shorter opposite side is designed for the top lip. That is, the larger curved arc is at a bottom portion of the cross section and the smaller curved arc is at an upper portion of the cross section. Further details of these sides are provided below. While the cross section of this example includes the four sides described above with one arc being larger than another arc, the cross section may include other configurations. For example, the cross section may include two or more peripheral portions. Further, in a preferred example, the cross section has a water drop shape with a pointy upper tip and round bottom tip.

FIG. 1B illustrates a side view of the exemplary lipstick device 100, along with a side view of the lipstick container portion 110, the container base 135, and the handle 120. In this view, the slanted top application end 130 is observed. In another embodiment, the top application end 130 may instead be flat (or perpendicular to the longitudinal axis of the lipstick 100).

Figure 2:
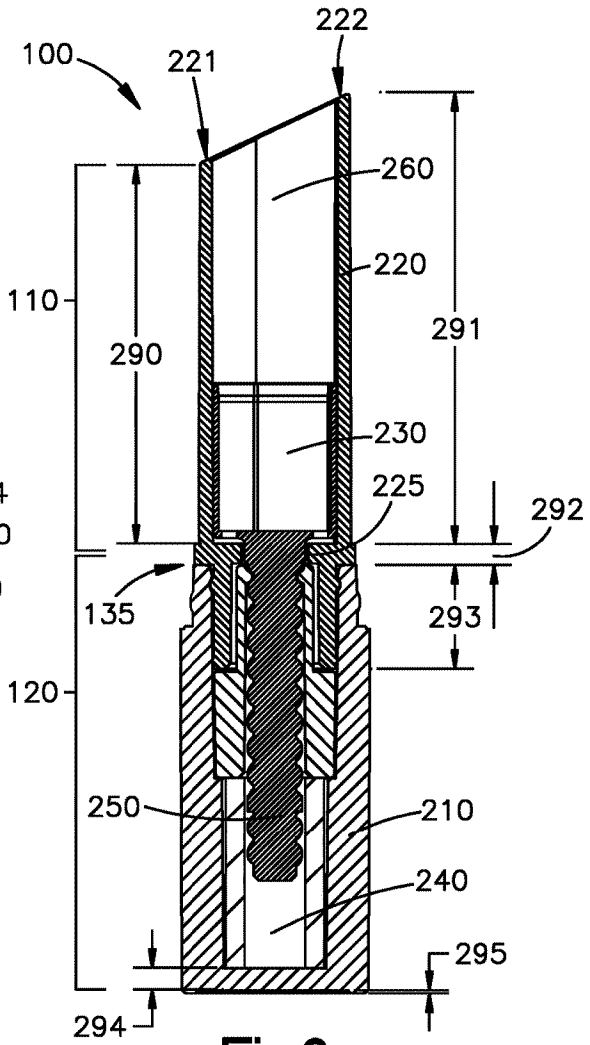
FIG. 2 is a diagram illustrating a longitudinal cross section view of an example of a device for applying cosmetic or treatment material to lips.

FIG. 1C illustrates a front view of the exemplary lipstick device 100, along with a front view of the lipstick container portion 110, the container base 135, and the handle 120. In the illustrated embodiment, the top application end 130 of the lipstick container 110 is slanted. In particular, there is an upward slant from the larger curved arc side to the shorter opposite side. In another example, the opposite configuration may be used where there is a downward slant from the larger curved arc side to the shorter opposite side. The distance between the application end 130 and the base end 135 extending longitudinally from the shorter opposite side is greater than the distance between the application end 130 and the base end 135 extending longitudinally from the larger curved arc side. In this figure, a longitudinal cross section 199 is indicated. The detailed illustration of the cross section 199 is shown in FIG. 2.

Figure 1E:
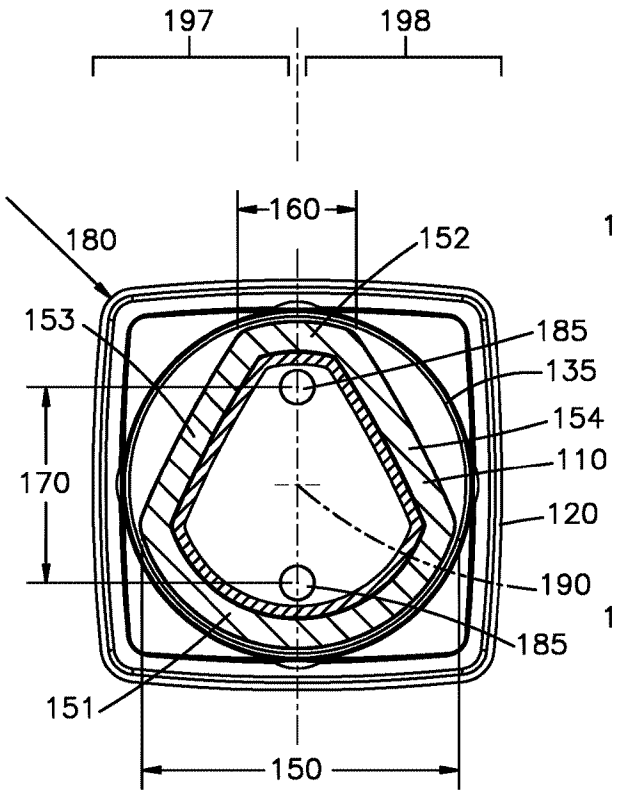
Figure 1D:
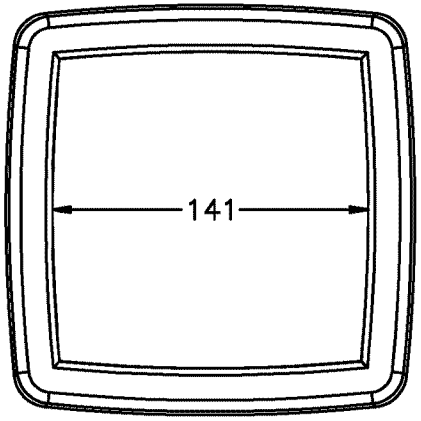

FIG. 1D illustrates a bottom view of the exemplary lipstick device 100, which is also the bottom 140 of the handle 120. In the illustrated embodiment, the bottom 140 is substantially a square with slightly curved sides. In one example, the bottom 140 may include a protruding border surrounding an interior base. In a preferred embodiment, the greatest distance 141 between the inside walls of the protruding border (or the widest point of the interior base) is 13.9 millimeters (mm). It should be appreciated that the handle 120 can be any shape, including a square with straight edges, rectangle, circle, oval, etc.

FIG. 1E illustrates a top view of the exemplary lipstick device 100, which includes a top view of the lipstick container 110, container base 135, and handle 120. To simplify the description, a conceptual radial axis is drawn from the center of the top view to symmetrically divide the view into a left side 197 and a right side 198. As shown in this Figure, the lipstick container 110 includes a hollow casing defined by four peripheral portions or sides. A first peripheral portion or side 152 is illustrated on the top. This first peripheral portion 152 may be an arc. In some embodiments, the arc may be centered at the aforementioned radial axis and have an outward radial direction stemming from the center of the hollow portion of the lipstick container 110. In other embodiments, the first peripheral portion 152 may also be a substantially straight line. On the opposite end of the first peripheral portion 152 is a second peripheral portion 151, which may be a longer second arc (or in other embodiments, a longer substantially straight line) compared to the first peripheral portion 152. The larger arc 151 may be centered at the radial axis and have an outward radial direction stemming from the center. In some embodiments, the distance 150 between the end points of the larger arc 151 (or the chord length of the larger arc 151) is at least twice as long as the distance 160 between the end points of the smaller arc 152 (or the chord length of the smaller arc 152). In a preferred embodiment, for example, the chord length 150 of the larger arc 151 measured from the outside of the container 110 is 14 mm, and the chord length 160 of the smaller arc 152 measured from the outside container 110 is 5 mm (the chord length ratio between the two is thus 14:5). Further, in a preferred embodiment, the larger arc 151 may have a radius of 7.2 mm, extending from the center 190. The end points of the smaller arc 152 and the larger arc 151 on the left side 197 of the view are connected by a third peripheral portion 153, which may be a substantially straight line. Similarly, a fourth peripheral portion 154, which may be a substantially straight line, may connect the end points of the smaller arc 152 and the larger arc 151 on the right side 198 of the view. As discussed above, the portion of the lipstick adjacent to the smaller arc 152 may be designed for application to a person's upper lip and the larger arc 151 may be designed for application to a person's lower lip.

FIG. 1E further illustrate that the corner edges 180 of the handle 120 may be rounded, such as having a radius of 1.5 mm. In addition, it is shown that two studs 185 configured to secure a lipstick body (not illustrated) can be seen through the center hollow portion of the lipstick container 110. In a preferred embodiment, each stud 185 may have a diameter of 1.5 mm and may be aligned with the aforementioned radial axis. In a preferred embodiment, the two studs 185 may be separated by a distance 170 of 8.6 mm. It should be appreciated, however, that any number of studs may be used and they may be configured in any pattern. Further, it should be appreciated that any other device known in the art for securing the lipstick body may be used.

FIG. 2 illustrates a longitudinal cross sectional view of an exemplary lipstick device 100 corresponding to the cross section 199 identified in FIG. 1C. In the embodiment shown, the handle 120 includes an exterior portion 210 having a bottom and sides that surround an interior hollow portion. As discussed above with reference to FIG. 1D, the bottom of the handle 120 may include a protruding border surrounding an interior base. In a preferred embodiment, the protruding border may have a thickness 295 of 0.3 mm from the base, and the thickness 294 of the interior base may be 2.05 mm. The interior hollow portion of the handle 120 may include a cylindrical channel 240 extending along the longitudinal axis.

FIG. 2 also shows the cross sectional view of the lipstick container 110 and container base 135. The lipstick container 110 includes a hollow portion 260 defined by walls 220. In the illustrated embodiment, one side of the wall is shorter than the opposite side. As previously discussed, the shorter side 221 may extend longitudinally from the larger arc 151 and the longer side 222 may extend longitudinally from the smaller arc 152. In a preferred embodiment, the distance 291 on the longer side 222 between the top application end and the base 135 may be 42.6 mm, and the distance 290 on the shorter side 221 between the top application end and the base 135 may be 36.5 mm. The base 135 itself may have a thickness 292 of 2 mm in a preferred embodiment. The edge of the base 135 may rest on top of the top edge of the handle's 120 exterior portion 210, as shown. Beneath the base 135, a cylindrical extension of the lipstick container 110 may extend into the hollow portion of the handle 120 and be adjacent to the handle's 120 interior wall. In a preferred embodiment, the length 293 of the cylindrical extension may be 9.8 mm. The base 135 may extend inward slightly 225 to provide support for a holder 230 for the lipstick. The holder's 230 external dimensions are slightly less than the interior dimensions of the hollow portion 260 and is configured to move up and down the hollow portion 260. The bottom of the holder 230 is coupled to a rod with helical threads 250 positioned within the cylindrical channel 240 in the handle 120. When rotated by the user, the helical threads of the rod 250 allow the holder 230—along with the lipstick it holds—to move up or down in a controlled manner. In a preferred embodiment, with reference to FIG. 4A, the distance 484 between the top of the rod 250 and the top of the holder 230 is 14 mm, and the distance 485 between the top of the holder 230 and the shorter side 221 of the lipstick container 110 is 21.25 mm.

Figure 3D:
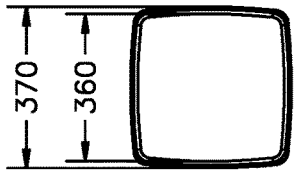
FIGS. 3A-3D are diagrams illustrating various views of an example of a capped device for applying cosmetic or treatment material to lips.
Figure 3C:
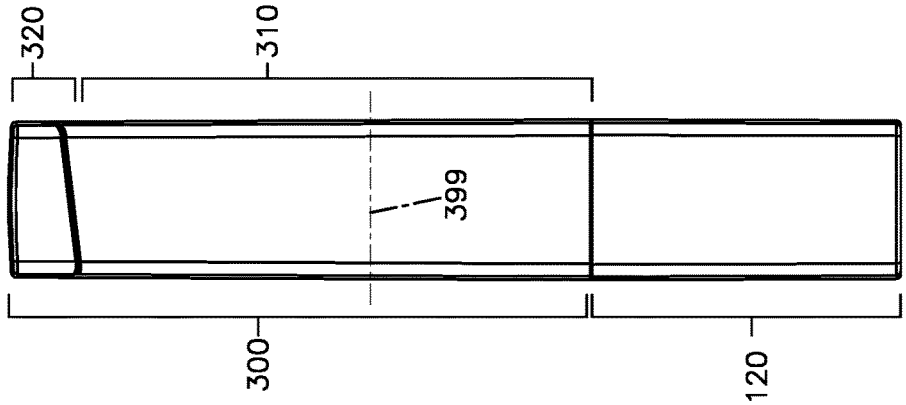
Figure 3B:
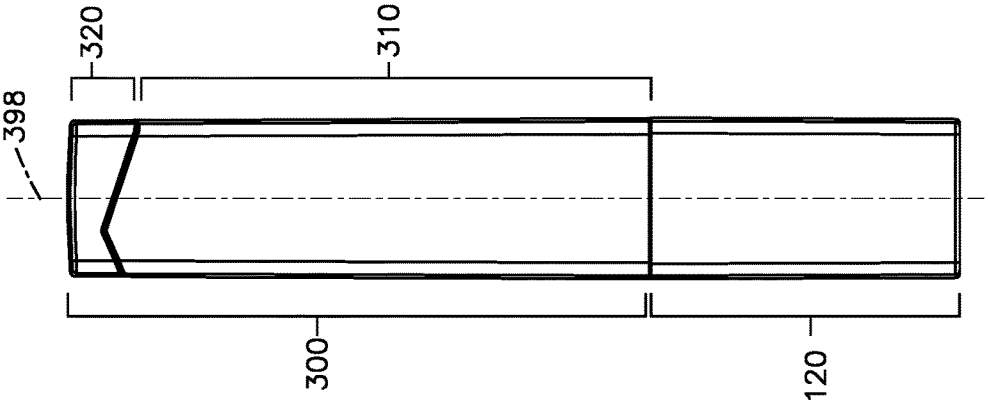
Figure 3A:
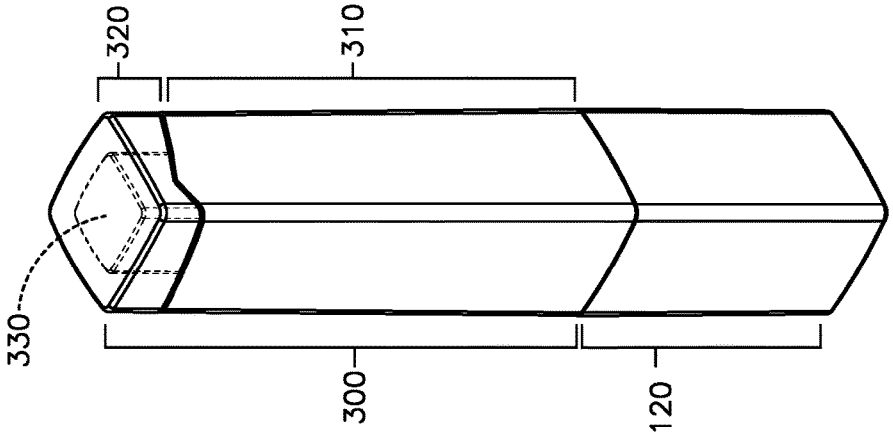

FIG. 3A-3D illustrate various views of an exemplary lipstick device having a cap 300. FIG. 3A is a perspective view and shows the cap 300 extending along the longitudinal axis of the lipstick and resting on top of the handle 120. The cap 300 has a clear portion 320 made with a transparent or translucent material such that a color sample 330 located within may be visible. The color sample 330 can be the same color as the lipstick and may be made with any suitable material, including the actual material of the lipstick. The position of the color sample 330 may be fixed within the cap 300 and not dependent on the position of the lipstick (which may be extended or retracted within the cap, or simply depleted due to use). The rest of the cap 310 can be made with any material, including those that are opaque.

FIG. 3B illustrates a side view of the exemplary capped lipstick device. From this side, it is seen that the clear portion 320 may adjoin the bottom portion 310 in a jagged pattern. It should be understood that any pattern may be used instead. Also illustrated is an imaginary line 398 representing the location of the longitudinal cross section shown in FIG. 4A.

FIG. 3C illustrates another side view of the exemplary capped lipstick device adjacent to the side shown in FIG. 3B. From this side, it is seen that the adjoining pattern between the clear portion 320 and the bottom portion 310 is a slanted straight line. Again, it should be understood that any pattern may be used instead. Also illustrated is an imaginary line 399 representing the location of the latitudinal cross section shown in FIG. 4B.

FIG. 3D illustrates a top view of the exemplary cap 300. The cap 300 may have equal length sides that are substantially straight with slight outward curvatures. In a preferred embodiment, the widest part 370 of a side may be 18 mm, and the narrowest part 360 of that side may be 17 mm. It should be understood that the cap 300 could have any other dimensions and/or shapes.

Figure 4A:
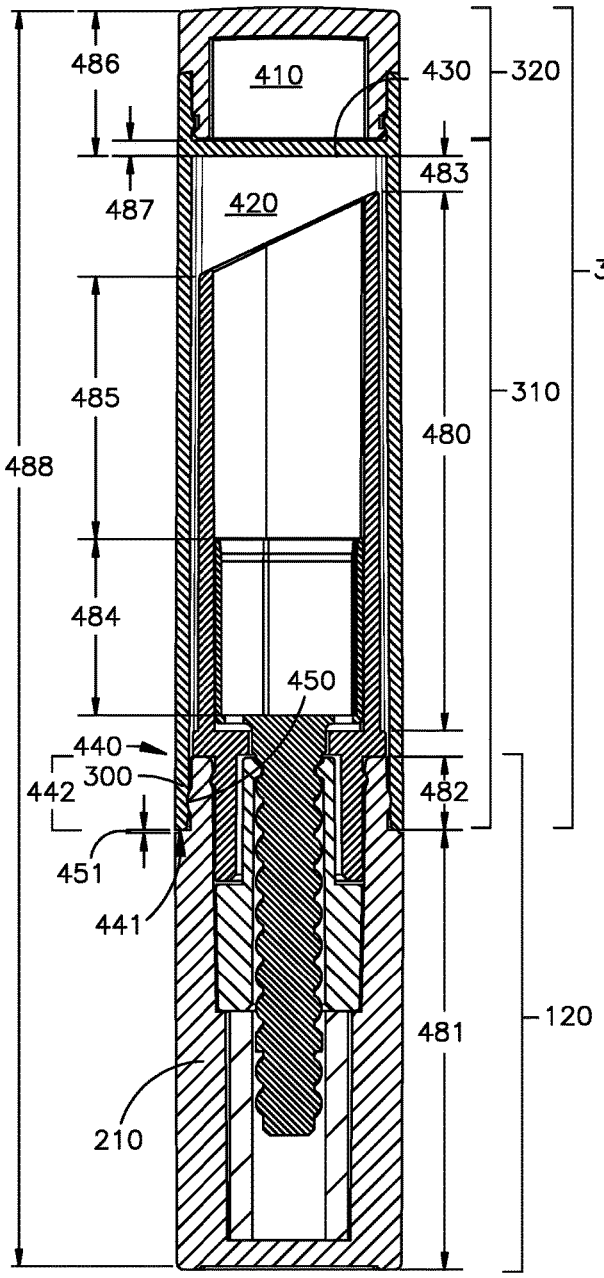
FIGS. 4A and 4B are diagrams illustrating various cross sectional views of a capped device for applying cosmetic or treatment material to lips.

FIG. 4A illustrates a longitudinal cross sectional view of an exemplary capped lipstick device corresponding to the cross section 398 identified in FIG. 3B. The cap 300 includes an enclosed space 410 formed by the top and sides of the cap 300 and a divider 430. The enclosed space 410 in some embodiments may be used to place a color sample for the lipstick, visible through the clear portion 320 of the cap 300. In a preferred embodiment, the divider 430 has a thickness 487 of 1.2 mm, and the height 486 of the enclosed space 410 measured from the top of the cap 300 to the bottom of the divider 430 is 11.75 mm.

In addition, the cap 300 includes a hollow portion 420 within which the lipstick container 110 is enclosed. The hollow portion 420 is formed by the divider 430 and the walls of the cap 300. In a preferred embodiment, when the cap is secured, the clearance 483 between the bottom of the divider 430 and the highest point of the lipstick container 110 is 2.85 mm. With the cap on, in a preferred embodiment the height 488 of the capped lipstick device is 99.8 mm.

The bottom of the cap 300 fits on top of the walls of the exterior portion 210 of the handle 120. Referring to the area labeled 440, the top of the handle's 120 wall includes a lower cutout external portion 441 with a width that is substantially the same as the thickness of the cap's 300 wall, followed by a substantially higher internal portion 442. When the cap 300 is on, the wall of the cap fits on top of the handle's 120 lower cutout external portion 441, and the interior of the cap's 300 wall is adjacent to the exterior of the substantially higher internal portion 442 of the handle's 120 wall. To secure the cap, the substantially higher internal portion 442 includes an outward facing protrusion 450. In the embodiment shown, that protrusion is substantially rounded. In a preferred embodiment, the round protrusion may have a radius of 0.25 mm. When the cap is securely in place, in a preferred embodiment the gap 451 between the cap and the handle's 120 lower cutout external portion 441 is 0.25 mm. Further, in a preferred embodiment, the distance 481 between the lower cutout external portion 441 of the handle's 120 wall and the bottom of the handle 120 is 34.75 mm, and the distance 482 between the lower cutout external portion 441 and the top of the substantially higher internal portion 442 is 5.75 mm.

Figure 4B:
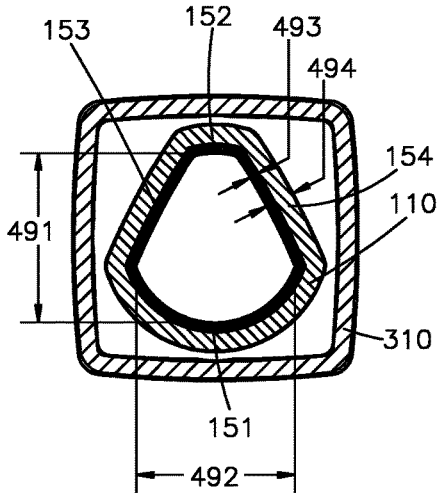

FIG. 4B illustrates a latitudinal cross sectional view of the exemplary capped lipstick device corresponding to the cross section 399 identified in FIG. 3C. The cross section shows the lipstick container 110 and the opaque portion of the case 310. In a preferred embodiment, the thickness 494 of the lipstick container 110 may be 1.26 mm. As discussed above, the lipstick container 110 includes a first peripheral portion 152, second peripheral portion 151, third peripheral portion 153, and fourth peripheral portion 154. Detailed descriptions of these portions were discussed above with reference to FIG. 1E and will not be repeated in the interest of brevity. FIG. 4B further illustrates dimensions related to the lipstick body contained within the lipstick container 110. In a preferred embodiment, the largest cross sectional length 491 of the lipstick body is 10.65 mm, and the largest cross sectional width 492 of the lipstick body is 10 mm. Further, in a preferred embodiment, the gap 493 between the lipstick body and the lipstick container 110 is 0.5 mm. This gap 493 distance may also correspond to the thickness of the lipstick holder 230.

Figure 5D:
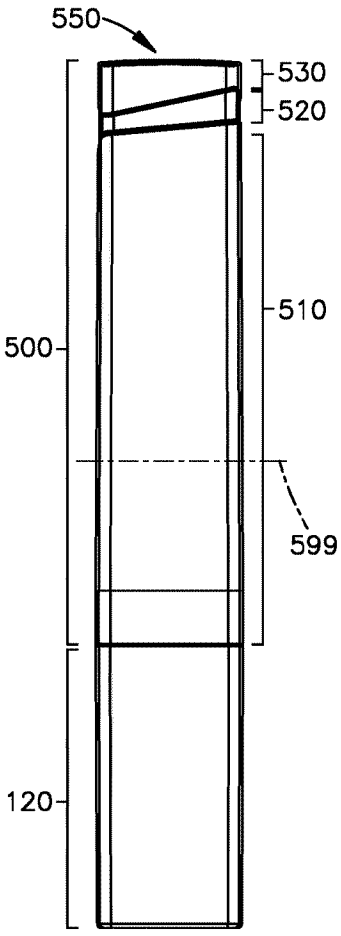
FIGS. 5A-5E are diagrams illustrating various views of an example of another capped device for applying cosmetic or treatment material to lips.
Figure 5C:
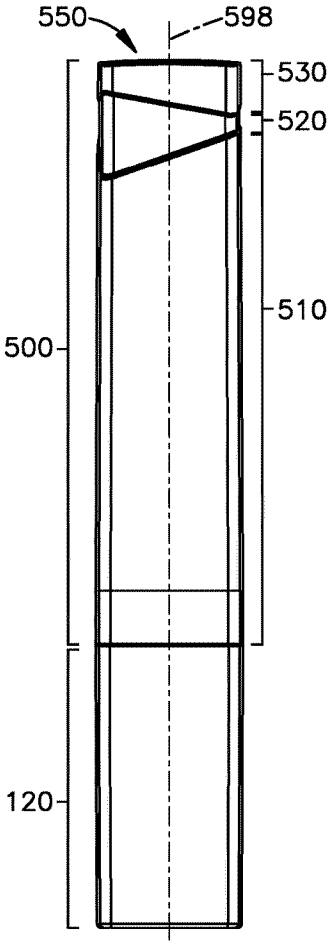
Figure 5B:
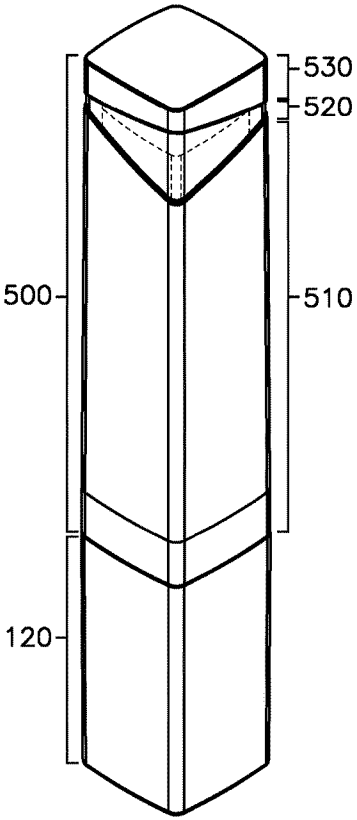
Figure 5A:
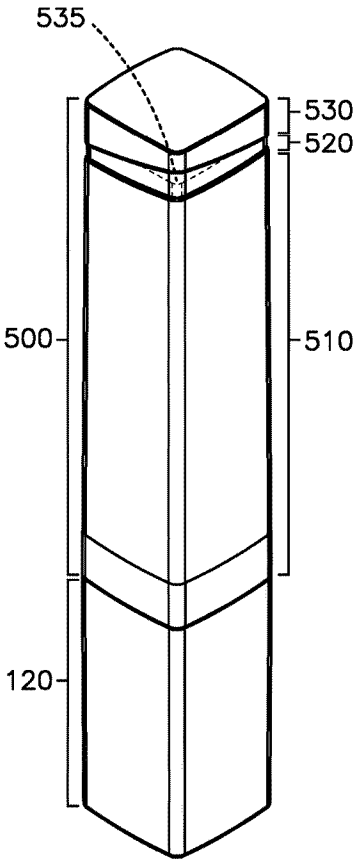

FIGS. 5A-5E illustrate various views of a lipstick device having another embodiment of a cap 500. FIG. 5A is a perspective view showing the exemplary cap 500 extending along the longitudinal axis of the lipstick and resting on top of the handle 120. The cap 500 includes a top opaque portions 530 and a bottom opaque portion 510, and sandwiched between is a clear portion 520 made with a transparent or translucent material such that a color sample 535 located within may be visible. The color sample 535 can be the same color as the lipstick and may be made with any suitable material, including the actual material of the lipstick. The position of the color sample 535 may be fixed within the cap 500 and not dependent on the position of the lipstick (which may be extended or retracted within the cap, or simply depleted due to use). In the example shown, the clear portion 520 varies in height and shape around the cap 500. The two visible sides shown in FIG. 5A illustrate the clear portion 520 gradually varying in height (both the top and bottom borders of the clear portion 520 have gradual slopes). In contrast, the two visible sides shown in FIG. 5B illustrates the clear portion 520 having much more drastic changes in height (on the left side, the bottom border of the clear portion 520 has a steep decreasing slope; on the right side, the bottom border has a steep increasing slope). It should be appreciated, however, that the shape and dimensions of the clear portion 520 should not be limited to this example and may take any form.

FIG. 5C illustrates a side view of the exemplary capped lipstick device. From this side, it is seen that the clear portion's 520 top border has a decreasing slope and the bottom border has a relatively steeper increasing slope. Also illustrated is an imaginary line 598 representing the location of the longitudinal cross section shown in FIG. 6A.

FIG. 5D illustrates another side view of the exemplary capped lipstick device. From this side, it is seen that the clear portion's 520 top border has a slight increasing slope and the bottom border has a lesser increasing slope. Again, it should be understood that any pattern may be used instead. Also illustrated is an imaginary line 599 representing the location of the latitudinal cross section shown in FIG. 6B.

Figure 5E:
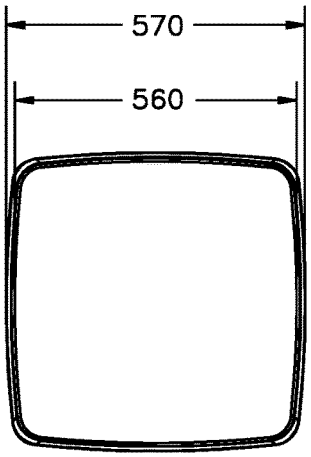

FIG. 5E illustrates a top view 550 of the exemplary cap 500. The cap 500 may have equal length sides that are substantially straight with slight outward curvatures. In a preferred embodiment, the widest part 570 of a side may be 18 mm, and the narrowest part 560 of that side may be 17 mm. It should be understood that the cap 500 could have any other dimensions and/or shapes.

Figure 6B:
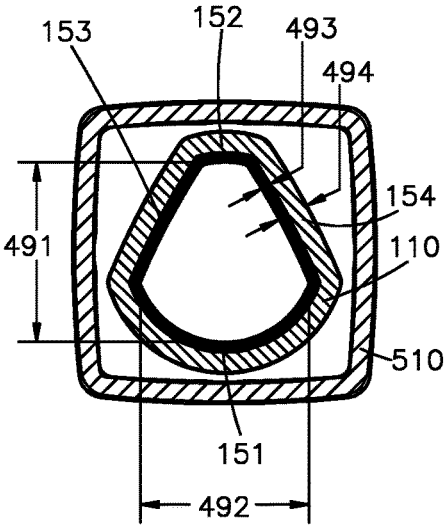
FIGS. 6A and 6B are diagrams illustrating various cross sectional views of a capped device for applying cosmetic or treatment material to lips.
Figure 6A:
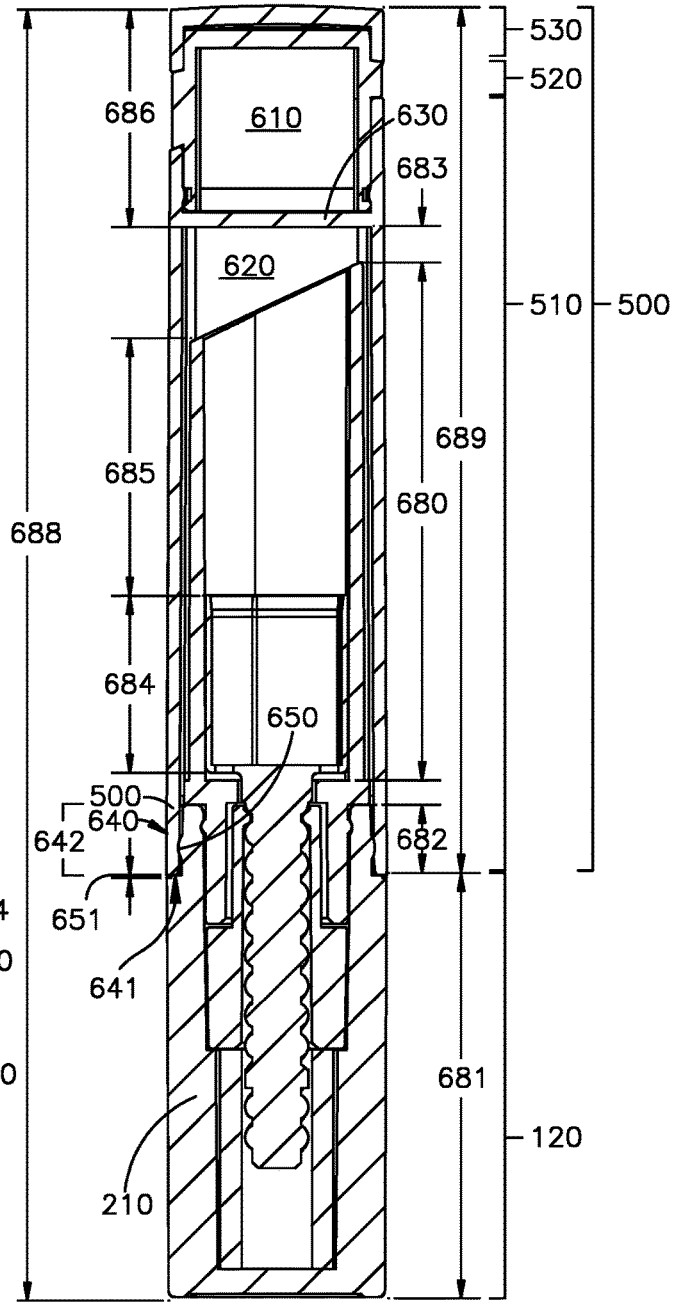

FIG. 6A illustrates a longitudinal cross sectional view of the capped lipstick device corresponding to the cross section 598 identified in FIG. 5C. The cap 500 includes an enclosed space 610 formed by the top and sides of the cap 500 and a divider 630. The enclosed space 610 in some embodiments may be used to place a color sample for the lipstick, visible through the cap's 500 clear portion 520 (represented in the illustration as gaps in the side walls of the cap, with the left side gap being wider than the right side gap). In a preferred embodiment, the height 686 of the enclosed space 610 measured from the top of the cap 500 to the bottom of the divider 630 is 18.25 mm.

In addition, the cap 500 includes a hollow portion 620 within which the lipstick container 110 is enclosed. The hollow portion 620 is formed by the divider 630 and the walls of the cap 500. In a preferred embodiment, when the cap is secured, the clearance 683 between the bottom of the divider 630 and the highest point of the lipstick container 110 is 2.85 mm. In a preferred embodiment, the cap 500 has a height 689 of 71.5 mm, and the lipstick device with the cap on has a height 688 of 106.25 mm.

The bottom of the cap 500 fits on top of the walls of the exterior portion 210 of the handle 120. Referring to the area labeled 640, the top of the handle's 120 wall includes a lower cutout external portion 641 with a width that is substantially the same as the thickness of the cap's 500 wall, followed by a substantially higher internal portion 642. When the cap 500 is on, the wall of the cap fits on top of the lower cutout external portion 641, and the interior of the cap's 500 wall is adjacent to the exterior of the substantially higher internal portion 642. To secure the cap, the substantially higher internal portion 642 of the handle's 120 wall includes an outward facing protrusion 650. In the embodiment shown, that protrusion 650 is substantially rounded. In a preferred embodiment, the round protrusion 650 may have a radius of 0.25 mm. When the cap is securely in place, in a preferred embodiment the gap 651 between the cap and the lower cutout external portion 641 of the handle's 120 wall is 0.25 mm. Further, in a preferred embodiment, the distance 681 between the lower cutout external portion 641 and the bottom of the handle 120 is 34.75 mm, and the distance 682 between the lower cutout external portion 641 and the top of the substantially higher internal portion 642 is 5.75 mm.

FIG. 6B illustrates a latitudinal cross sectional view of the capped lipstick device corresponding to the cross section 599 identified in FIG. 5D. The cross section shows the lipstick container 110 and the opaque portion of the case 510. In a preferred embodiment, the thickness 494 of the lipstick container 110 may be 1.26 mm. As discussed above, the lipstick container 110 includes a first peripheral portion 152, second peripheral portion 151, third peripheral portion 153, and fourth peripheral portion 154. Detailed descriptions of these portions were discussed above with reference to FIG. 1E and will not be repeated in the interest of brevity. FIG. 6B further illustrates dimensions related to the lipstick body contained within the lipstick container 110. In a preferred embodiment, the largest cross sectional length 491 of the lipstick body is 10.65 mm, and the largest cross sectional width 492 of the lipstick body is 10 mm. Further, in a preferred embodiment, the gap 493 between the lipstick body and the lipstick container 110 is 0.5 mm.

The container 110 described above may be used to hold the body of a lipstick (or lip gloss, lip balm, or any other lip cosmetic/treatment material). The lipstick body may extend along a longitudinal axis of the lipstick, having an application end and a base end opposite to the application end. The base end may be supported and secured by the holder 230 shown in FIG. 2, and the application end may extend out of or retract into the application end 130 shown in FIGS. 1A-1C of the lipstick container 110. The lipstick body's cross section perpendicular to its longitudinal axis may have a cross sectional dimension and shape similar to that of the interior of the container 110 as described above with reference to FIGS. 1E, 4B, and 6B. For instance, the cross section of the lipstick body may include a center through which a radial axis extends in parallel to the cross section. The radial axis conceptually divides the cross section of the lipstick body into a left side and a right side. The lipstick body may include four peripheral portions, similar to those of the lipstick container 110. For example, a first peripheral portion may form a first arc (or a substantially straight line) centered at the radial axis and having an outward radial direction stemming from the center. A second peripheral portion may form a second arc (or a substantially straight line) centered at the radial axis and having an outward radial direction stemming from the center, the second arc being opposite to the first arc and being longer than the first arc. A third peripheral portion may form a first substantially straight line connecting a first end point of the first arc and a first end point of the second arc in the left side of the cross section. A fourth peripheral portion may forms a second substantially straight line connecting a second end point of the first arc and a second end point of the second arc in the right side of the cross section. In some embodiments, the second arc's chord length may be at least twice as long as the first arc's chord length (e.g., the ratio of the second arc's chord length to the first arc's chord length may be 14 to 5). The application end of the lipstick body may be angled relative to the cross section, similar to the angled application end 130 of the lipstick container 110 shown in FIGS. 1A-1C. In one embodiment, the distance between the application end and the base end extending longitudinally from the first peripheral portion of the cross section is greater than a distance between the application end and the base end extending longitudinally from the second peripheral portion of the cross section.

It should be appreciated that while a number of preferred dimensions are provided above, the dimensions of the lipstick device 100 and other components described herein are not limited to the described dimensions. For example, the dimensions may be approximately or about the same as the dimensions provided, or may have different dimensions at about the same ratio. As used herein, the term approximately or about signifies a range of 30% to 300% of the described dimensions.

It should be appreciated that the lip application device described above has several advantages. For example, with respect to the lipstick body/container, the larger arc portion of the lipstick facilitates lower lip application, and the smaller arc portion facilitates upper lip application. Thus, rather than taking a one-size-fits-all approach, the lower lip and upper lip, which typically have different dimensions and characteristics, may each have an application surface that is designed for it. It should be appreciated by those skilled in the art that the advantages of the lip application device are not limited to those described herein and are merely examples of the advantages of the invention.

It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

It is claimed:

1. A lipstick container, comprising:

a container body extending along a longitudinal axis and comprising a first end having an upper portion and a lower portion, a second end, and a cross section perpendicular to the longitudinal axis, the cross section comprising:

a center through which an axis extends in parallel to the cross section, the axis dividing the cross section into a left side and a right side;

a first peripheral portion intersecting the axis at an upper portion of the cross section; and a second peripheral portion intersecting the axis at a lower portion of the cross section, wherein a distance extending longitudinally from the upper portion of the first end of the container body to the second end of the container body is different than a distance extending longitudinally from the lower portion of the first end of the container body to the second end of the container body, wherein the second peripheral portion is longer than the first peripheral portion, and the first peripheral portion comprises a first arc that is centered at the axis and extends away from the second peripheral portion, wherein the second peripheral portion comprises a second arc that is centered at the axis and extends away from the first peripheral portion, and wherein a cord length of the second arc is greater than as a chord length of the first arc.

2. The lipstick container of claim 1, wherein the second peripheral portion is an arc so that the first peripheral portion and the second peripheral portion form a water drop shape with a pointed upper portion at the axis.

3. The lipstick container of claim 1, wherein the chord length of the second arc is at least twice as long as the cord length of the first arc.

4. The lipstick container of claim 1, wherein the ratio of the chord length of the second arc to the cord length of the first arc is 14 to 5.

5. The lipstick container of claim 1, wherein the first end of the container body is angled relative to the cross section.

6. The lipstick container of claim 1, wherein the distance extending longitudinally from the upper portion of the first end of the container body to the second end of the container body is greater than the distance extending longitudinally from the lower portion of the first end of the container body to the second end of the container body.

7. The lipstick container of claim 1, wherein the cross section further comprises:

a third peripheral portion that forms a first substantially straight line connecting a first end point of the first peripheral portion and a first end point of the second peripheral portion in the left side of the cross section; and a fourth peripheral portion that forms a second substantially straight line connecting a second end point of the first peripheral portion and a second end point of the second peripheral portion in the right side of the cross section.

8. The lipstick container of claim 1, further comprising a lipstick that is telescopically attached to the container body and comprises an application end and a base end, wherein the first end of the container body is an application end that corresponds to the application end of the lipstick, and the second end of the container body is a base end that corresponds to the base end of the lipstick.

9. The lipstick container of claim 1, further comprising a cover that is removably attached to the container body, the cover comprising a transparent window for indicating a color of a lipstick that is housed by the lipstick container.

10. The lipstick container of claim 1, further comprising a base and a lipstick holder, wherein the lipstick holder is rotatably attached to the base.

11. A lipstick, comprising:

a container extending along a longitudinal axis; and a lipstick body positioned within the container, extending along the longitudinal axis, and comprising a first end having an upper portion and a lower portion, a second end, and a cross section perpendicular to the longitudinal axis, the cross section comprising:

a center through which an axis extends in parallel to the cross section, the axis dividing the cross section into a left side and a right side;

a first peripheral portion intersecting the axis at an upper portion of the cross section; and a second peripheral portion intersecting the axis at a lower portion of the cross section, wherein a distance extending longitudinally from the upper portion of the first end of the lipstick body to the second end of the lipstick body is different than a distance extending longitudinally from the lower portion of the first end of the lipstick body to the second end of the lipstick body, wherein the second peripheral portion is longer than the first peripheral portion, and the first peripheral portion comprises a first arc that is centered at the axis and extends away from the second peripheral portion, wherein the second peripheral portion comprises a second arc that is centered at the axis and extends away from the first peripheral portion, and wherein a cord length of the second arc is greater than as a chord length of the first arc.

12. The lipstick of claim 11, wherein the second peripheral portion is an arc so that the first peripheral portion and the second peripheral portion form a water drop shape with a pointed upper portion at the axis.

13. The lipstick of claim 11, wherein the chord length of the second arc is at least twice as long as the cord length of the first arc.

14. The lipstick of claim 11, wherein the ratio of the chord length of the second arc to the cord length of the first arc is 14 to 5.

15. The lipstick of claim 11, wherein the first end of the lipstick body is an application end and the second end of the lipstick body is a base end.

16. The lipstick of claim 11, wherein the distance extending longitudinally from the upper portion of the first end of the lipstick body to the second end of the lipstick body is greater than the distance extending longitudinally from the lower portion of the first end of the lipstick body to the second end of the lipstick body.

17. The lipstick of claim 11, wherein the cross section further comprises:

a third peripheral portion that forms a first substantially straight line connecting a first end point of the first peripheral portion and a first end point of the second peripheral portion in the left side of the cross section; and a fourth peripheral portion that forms a second substantially straight line connecting a second end point of the first peripheral portion and a second end point of the second peripheral portion in the right side of the cross section.

18. A lipstick container, comprising:

a container body extending along a longitudinal axis and comprising a cross section perpendicular to the longitudinal axis, wherein the cross section of the container body has a first curved peripheral portion on a right side thereof and a second curved peripheral portion on a left side thereof opposite to the right side, wherein the second curved peripheral portion is longer than the first peripheral portion, and the first peripheral portion comprises a first arc that is centered at the axis and extends away from the second peripheral portion, wherein the second curved peripheral portion comprises a second arc that is centered at the axis and extends away from the first peripheral portion, and wherein a cord length of the second arc is greater than as a chord length of the first arc.

19. The lipstick container of claim 18, wherein the container body further comprises (i) a first end having an upper portion which is the first curved peripheral portion and a lower portion which is the second curved peripheral portion and (ii) a second end, and wherein a distance extending longitudinally from the upper portion of the first end of the container body to the second end of the container body is different than a distance extending longitudinally from the lower portion of the first end of the container body to the second end of the container body.

20. A lipstick, comprising:

a container extending along a longitudinal axis; and a lipstick body positioned within the container, extending along the longitudinal axis, and comprising a cross section perpendicular to the longitudinal axis, wherein the cross section of the lipstick body has a first curved peripheral portion on a right side thereof and a second curved peripheral portion on a left side thereof opposite to the right side, wherein the second curved peripheral portion is longer than the first peripheral portion, and the first peripheral portion comprises a first arc that is centered at the axis and extends away from the second peripheral portion, wherein the second curved peripheral portion comprises a second arc that is centered at the axis and extends away from the first peripheral portion, and wherein a cord length of the second arc is greater than as a chord length of the first arc.

21. The lipstick of claim 20, wherein the lipstick body further comprises (i) a first end having an upper portion which is the first curved peripheral portion and a lower portion which is the second curved peripheral portion, and (ii) a second end, and wherein a distance extending longitudinally from the upper portion of the first end of the lipstick body to the second end of the lipstick body is different than a distance extending longitudinally from the lower portion of the first end of the lipstick body to the second end of the lipstick body.

22. The lipstick container of claim 18, wherein the cross section further comprises:

a fourth peripheral portion that forms a further straight line connecting another end point of the first peripheral portion and another end point of the second peripheral portion.

23. The lipstick of claim 20, wherein the cross section further comprises:

a fourth peripheral portion that forms a further straight line connecting another end point of the first peripheral portion and another end point of the second peripheral portion.

* * * * *